US006463757B1

(12) United States Patent
Dickson et al.

(10) Patent No.: US 6,463,757 B1
(45) Date of Patent: Oct. 15, 2002

(54) INTERNAL HEAT EXCHANGER ACCUMULATOR

(75) Inventors: Timothy R. Dickson, Kingston; Wayne Whittle; Michelle M. Stobbart, both of Belleville, all of (CA)

(73) Assignee: Halla Climate Controls Canada, Inc., Belleville (CA)

( * ) Notice: Subject to any disclaimer, the term of this patent is extended or adjusted under 35 U.S.C. 154(b) by 0 days.

(21) Appl. No.: 09/864,505

(22) Filed: May 24, 2001

(51) Int. Cl.[7] ..... F25B 43/00; F25B 41/00; F25B 43/04; F25B 39/04; B21D 51/16

(52) U.S. Cl. ..... 62/503; 62/113; 62/475; 62/509; 62/513; 29/890.06

(58) Field of Search ..... 29/890.06; 62/113, 62/474, 475, 503, 509, 513; 95/117

(56) References Cited

U.S. PATENT DOCUMENTS

| | | | | | |
|---|---|---|---|---|---|
| 4,111,005 | A | | 9/1978 | Livesay | |
| 4,199,960 | A | | 4/1980 | Adams et al. | |
| 4,217,763 | A | * | 8/1980 | Ecker | 62/503 |
| 4,229,949 | A | | 10/1980 | Brandin | |
| 4,270,934 | A | | 6/1981 | Widdowson et al. | |
| 4,331,001 | A | | 5/1982 | Jones | |
| 4,354,362 | A | | 10/1982 | Schumacher et al. | |
| 4,474,035 | A | | 10/1984 | Amin et al. | |
| 4,509,340 | A | | 4/1985 | Mullally et al. | |
| 4,627,247 | A | | 12/1986 | Morse | |
| 4,633,679 | A | | 1/1987 | Wintersteen | |
| 4,651,540 | A | | 3/1987 | Morse | |
| 4,768,355 | A | * | 9/1988 | Breuhan | 62/503 |
| 4,994,185 | A | | 2/1991 | Cullen et al. | |
| 5,021,792 | A | | 6/1991 | Hwang | |
| 5,052,193 | A | | 10/1991 | Pettitt et al. | |
| 5,075,967 | A | * | 12/1991 | Bottum | 29/890.06 |
| 5,177,982 | A | | 1/1993 | Plemens | |
| 5,179,844 | A | * | 1/1993 | Lyman | 62/503 |
| 5,184,479 | A | | 2/1993 | Koberstein et al. | |
| 5,184,480 | A | | 2/1993 | Kolpacke | |
| 5,201,792 | A | | 4/1993 | Study | |
| 5,245,833 | A | | 9/1993 | Mei et al. | |
| 5,347,829 | A | | 9/1994 | Newman | |
| 5,471,854 | A | | 12/1995 | Denolf | |
| 5,562,157 | A | | 10/1996 | Hasegawa et al. | |
| 5,575,833 | A | * | 11/1996 | Griffin | 95/117 |
| 5,609,036 | A | | 3/1997 | Nagasawa et al. | |
| 5,622,055 | A | * | 4/1997 | Mei | 62/113 |
| 5,660,058 | A | | 8/1997 | Harris et al. | |

(List continued on next page.)

FOREIGN PATENT DOCUMENTS

| | | | | |
|---|---|---|---|---|
| DE | 19903833 | * | 8/2000 | 62/513 |
| DE | 19944950 | | 3/2001 | |
| EP | 0894651 | | 2/1999 | |

OTHER PUBLICATIONS

International Search Report (PCT/CA01/00083).

*Primary Examiner*—William C. Doerrler
*Assistant Examiner*—Filip Zec
(74) *Attorney, Agent, or Firm*—Baker & Daniels

(57) ABSTRACT

An accumulator for an air-conditioning (refrigeration or heat pump) system is designed to reduce flooding due to greater effective internal volume while at the same time incorporating an internal heat exchanger for better system performance, and providing better evaporation and controlled thermal properties. The accumulator embodies an outer housing that co-axially surrounds an inner liner. The inlet directs the refrigerant into the inner volume formed by the liner, wherein the liquid refrigerant and compressor oil are contained and insulated from the wall of the outer housing. A heat exchanger is arranged in the annular space between the outer housing and the inner liner and circulates a flow of condensate therethrough before delivering it to the expansion device. In this way the condensate is cooled for higher performance and at the same time refrigerant passing out of the accumulator is vaporized more completely.

32 Claims, 8 Drawing Sheets

U.S. PATENT DOCUMENTS 5,678,419 A 10/1997 Sanada et al.
5,701,758 A 12/1997 Haramoto et al.
5,701,795 A 12/1997 Friedrichsen
5,729,998 A 3/1998 Grohs et al.
5,746,065 A 5/1998 Patel et al.
5,778,697 A 7/1998 Wantuck
5,787,729 A 8/1998 Wijaya
5,850,743 A * 12/1998 Dreiman ..... 62/503
5,865,038 A * 2/1999 Maxwell ..... 62/474
5,904,055 A 5/1999 Slais
6,032,482 A * 3/2000 Krauss ..... 62/513
6,167,720 B1 1/2001 Chisnell
6,185,957 B1 * 2/2001 Voss ..... 62/513
6,220,050 B1 * 4/2001 Cooksey ..... 62/503
6,253,572 B1 * 7/2001 Bottum ..... 62/509
6,298,687 B1 * 10/2001 Dienhart ..... 62/513
6,318,116 B1 * 11/2001 Gabel ..... 62/475

* cited by examiner

INTERNAL HEAT EXCHANGER ACCUMULATOR

BACKGROUND OF THE INVENTION a) Field of the Invention

The present invention relates to improvements of an accumulator for use in an air-conditioning or heat pump system, and more particularly to a suction accumulator suitable for use in an air-conditioning system of a motor vehicle.

b) Description of the Prior Art

Closed-loop refrigeration/heat pump systems conventionally employ a compressor that is meant to draw in gaseous refrigerant at relatively low pressure and discharge hot refrigerant at relatively high pressure. The hot refrigerant condenses into liquid as it is cooled in a condenser. A small orifice or valve divides the system into high and low-pressure sides. The liquid on the high-pressure side passes through the orifice or valve and turns into a gas in the evaporator as it picks up heat. At low heat loads it is not desirable or possible to evaporate all the liquid. However, liquid refrigerant entering the compressor (known as "flooding") causes system efficiency loss and can cause damage to the compressor. Hence it is standard practice to include an accumulator between the evaporator and the compressor to separate and store the excess liquid.

An accumulator for an automotive air-conditioner system is typically a metal can, welded together, and often has fittings attached for a switch and/or charge port. One or more inlet tubes and an outlet tube pierce the top, sides, or occasionally the bottom, or attach to fittings provided for that purpose. The refrigerant flowing into a typical accumulator will impinge upon a deflector or baffle intended to reduce the likelihood of liquid flowing out the exit.

Some prior art is concerned with reducing the turbulence of the inlet flow (U.S. Pat. No. 5,184,480) as a way to reduce liquid carryover. Other designs are more concerned with the coupling between the inner reservoir and the outlet passage (U.S. Pat. Nos. 5,660,058, 5,179,844, 4,627,247), mainly to reduce the pressure drop across the accumulator (a critical system performance parameter).

Another feature of the prior art is the inclusion of a desiccant in the accumulator. Some refrigerant systems are more susceptible to moisture ingression and damage than others, especially less modern systems. For many systems it is necessary to remove any moisture, and the accumulator is a convenient spot to house the desiccant. Many early designs featured desiccant cartridges and the like (U.S. Pat. Nos. 4,509,340, 4,633,679, 4,768,355, 4,331,001), but the typical modern usage is a fabric bag of some suitable shape, full of desiccant beads and secured to some inner feature of the accumulator (like the J-shaped outlet tube) where the beads will contact the liquid refrigerant.

A further feature typical of the prior art is the use of insulation placed around the outside of accumulators to modify the thermal characteristics (U.S. Pat. No. 5,701,795). This is an added expense and is only used when required to reduce flooding.

One common feature of accumulators in typical usage is that they employ some technique to return compressor oil to circulation. Compressor oil generally circulates with the refrigerant throughout the system, but tends to accumulate in the reservoir of the accumulator. A typical method to return oil to circulation involves utilizing an outlet tube for the refrigerant gas that dips low into the reservoir before exiting the accumulator. A small hole in the outlet tube at the low point will allow liquid to be entrained in the gas flow to the compressor. It is inevitable that some of this liquid will be refrigerant. This liquid refrigerant returning to the compressor reduces system efficiency.

In normal operation the gas returning to the compressor is quite cool compared to the liquid from the condenser. It is well known that the cooling capacity and efficiency of the refrigeration cycle can be increased if the returning gas is used to further cool the liquid before it reaches the expansion device (U.S. Pat. No. 5,075,967). In systems that use an accumulator with an oil pick-up hole the effect can be enhanced as the liquid refrigerant entrained by the oil pick-up hole is evaporated to cool the condensate. A heat exchanger that is used to transfer heat from the high-pressure side to the low-pressure side is referred to as a "suction-line heat exchanger" (SLHX) or an "internal heat exchanger" (IHX). ("Internal" to the system, as compared to the condenser and evaporator that exchange heat between the system and the environment.) The typical heat exchanger in HVAC application is fin and plate. The prior art recognizes that a conventional heat exchanger can be used as an IHX (U.S. Pat. No. 5,562,157, U.S. Pat. No. 5,609,036, U.S. Pat. No. 5,687,419), but generally mobile applications do not have room for a larger evaporator and cannot economically justify another component. Combining the IHX with the accumulator can provide a cost-effective solution that requires only incrementally more space and weight.

Several examples of prior art suggest that a coil or section of tube containing hot condensate can be located within the reservoir section of the accumulator for heat exchange (U.S. Pat. No. 5,075,967, U.S. Pat. No. 5,245,833, U.S. Pat. No. 5,622,055), however such designs are not optimal. The hot condensate will boil the low-pressure liquid in the accumulator reservoir, defeating the purpose of the reservoir and reducing system efficiency by loading the system with gas. There is a requirement for an internal heat exchanger combined with an accumulator in a simple, cost and space effective configuration that is easily manufactured and preserves the accumulator function.

SUMMARY OF THE INVENTION

In our International PCT Application No. PCT/CA01/00083 filed Jan. 25th, 2001 we have disclosed a suction accumulator of advanced design which includes a number of important improvements rendering it particularly suitable for use in vehicle air-conditioning systems. The disclosure of the aforesaid International PCT application is incorporated herein in its entirety.

The present invention provides a still further improved suction accumulator.

More specifically, the invention provides an accumulator for use in an air-conditioning or heat pump system comprising: a hermetically sealed outer housing comprising a top, an inlet opening, an outlet opening, a peripheral side wall, and a base; an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage; a heat exchange tube positioned in said annular passage, said tube designed and configured to effect transfer of heat within said system from high pressure refrigerant to low pressure refrigerant, said tube having inlet and outlet ends that extend exteriorly of said outer housing; transfer passages at respective upper and lower ends of said annular passage, one-said transfer passage comprising an inlet communicating said annular passage to the interior of the inner liner and the other said transfer passage comprising an outlet communicating said annular passage to the exterior of said housing via said outlet opening; the arrangement being such that vaporized refrigerant drawn from said inner liner enters said annular passage through said one transfer passage, flows through said annular passage and along said heat exchange tube to said other transfer passage from where it exits said accumulator via said outlet opening. The flow of refrigerant gas in said annular passage can be in either direction as preferred.

The invention also provides an accumulator for use in an air-conditioning system comprising: a hermetically sealed outer housing comprising a cap, an inlet opening, an outlet opening, a peripheral side wall, and a base; an inner liner positioned within said outer housing, said inner liner having a peripheral wall and a base which form a container to receive refrigerant delivered through said inlet opening, said inner liner being spaced from the peripheral wall and the base of said outer housing to define therewith an annular clearance, said inner liner having an upper end that lies in contact with or adjacent said cap; a transfer passage for delivering refrigerant vapour from said container to said outlet opening; an internal heat exchanger for the high-pressure refrigerant being positioned in said annular clearance, said heat exchanger having inlet and outlet ends that extend exteriorly of said outer housing; wherein said inner liner is of low thermal conductivity to shield liquid refrigerant from excessive heat transfer from said outer container or from said coil.

The heat exchange tube provides a way of incorporating in the accumulator a mechanism for heat exchange between the high pressure side of the system, i.e. between the outlet of the compressor, the condenser and the expander valve, and the low pressure side of the system. As such the tube can embody any of the enhancements known or obvious to those skilled in heatexchanger art, such as those designed to increase surface area. Further, although the preferred embodiment is a single, continuous tube other configurations are possible. Effective heat exchange is accomplished by circulating the relatively hot refrigerant from the high pressure side through the heat exchange tube while passing over this heat exchange tube the gaseous refrigerant leaving the accumulator and being delivered to the inlet of the compressor. This both pre-cools the liquid refrigerant prior to expansion, increasing the system cooling capacity, and helps to ensure that the refrigerant gas flow reaching the compressor does not contain any liquid refrigerant. The effective heat exchange is accomplished with minimal increase in suction line pressure loss and without compromising the accumulator function. The heat exchanger disclosed herein has few additional parts, is more effective, and in its preferred embodiments is easier and cheaper to manufacture than accumulator and internal heat exchanger combinations as known in the prior art.

Preferably the heat exchange tube is arranged in the form of a helical coil in the annular passage between the outer housing and the inner liner of the accumulator so as to define in that angular passage a helical flow path for the refrigerant vapor along the length of the coil. The outer diameter of the heat exchange tube is matched to the width of the annular passage between the outer housing and the inner liner and thus virtually all of the refrigerant gas flow travels the full length of the helical path.

The inner liner is preferably fabricated in a plastic material of poor heat conductivity so that the liquid refrigerant contained therein is insulated from the heat of the coil and of the outer housing.

BRIEF DESCRIPTION OF THE DRAWINGS

The invention will further be described, by way of example only, with reference to the accompanying drawings wherein.

BRIEF DESCRIPTION OF THE PREFERRED EMBODIMENTS

Figure 1:
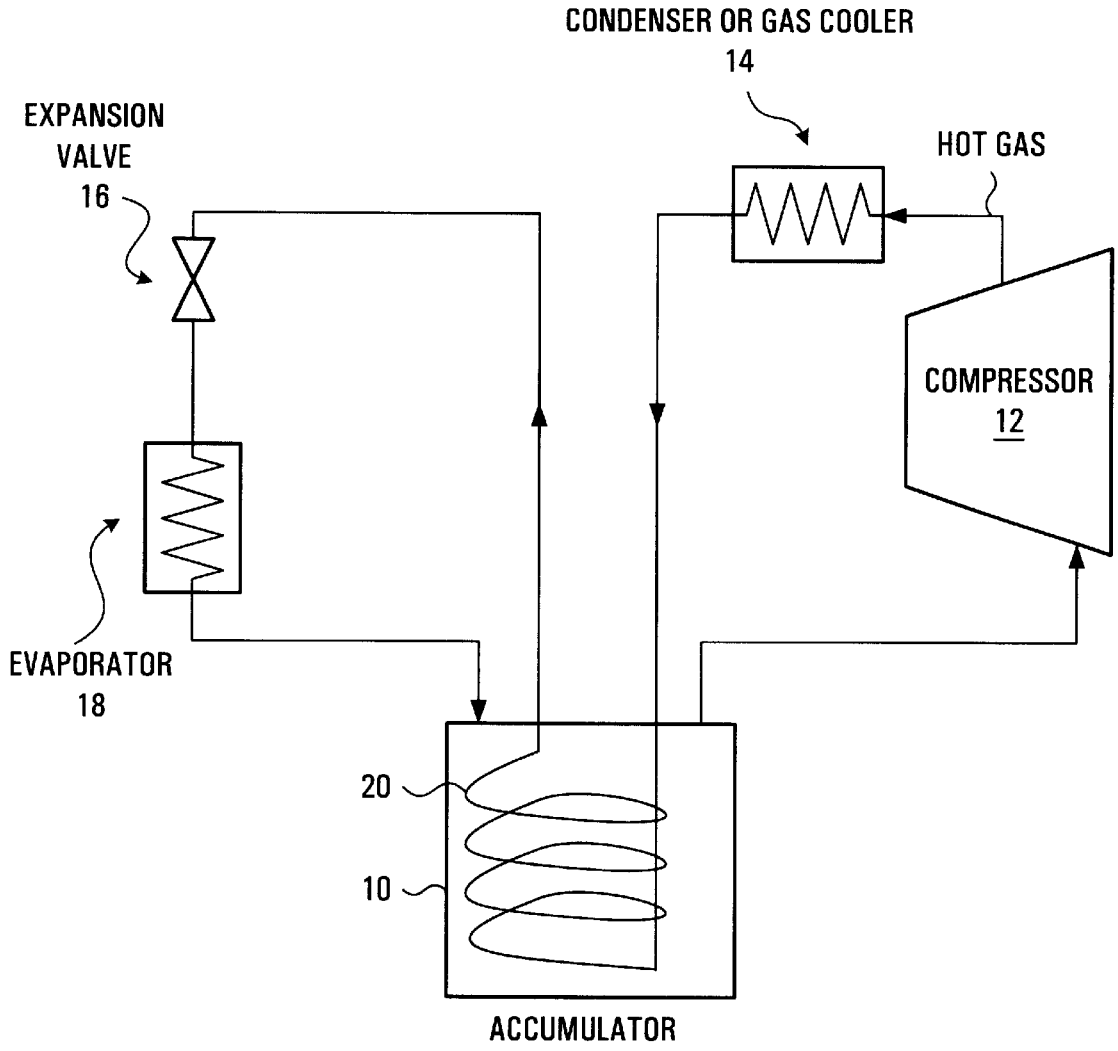
FIG. 1 is a schematic circuit diagram of an air-conditioning system (which may be used for cooling or for heating) embodying a presently preferred embodiment of the accumulator in accordance with the present invention.

The circuit diagram of FIG. 1 shows a schematic closed circuit air-conditioning system which may be used as a cooling unit or as a heat pump. Refrigerant fluid is stored in liquid form in an accumulator 10 to be drawn therefrom in gaseous form to the inlet of a compressor 12. The compressor delivers hot high-pressure refrigerant gas to a condenser 14 where the gas is cooled and typically partially converted to a liquid form. Refrigerant fluid from the condenser (still under high pressure) is expanded to a lower pressure through an expander valve 16, thereby undergoing a rapid drop in temperature, the low pressure cold fluid being heated in an evaporator 18 from where it is returned to the accumulator 10 in a mixed flow of liquid and gas. Depending upon the loading of the system more or less of the refrigerant fluid is condensed and evaporated, refrigerant that is in excess of the instantaneous requirements of the system being stored in liquid form in the accumulator 10. As thus far described, the circuit shown in FIG. 1 is conventional.

The system of FIG. 1 is modified by directing the partially cooled but still warm refrigerant fluid delivered from the condenser through a heat exchange coil 20 in the accumulator. As is more fully described hereinafter, the heat exchange coil 20 is not in contact with the refrigerant liquid in the accumulator 10, but rather is positioned to be contacted by refrigerant gas that is withdrawn from the accumulator by the compressor 12, and its purpose to pre-cool the high-pressure refrigerant and to ensure complete vaporization of the refrigerant delivered to the compressor.

The structure of accumulator 10 is more clearly shown in FIGS. 2 to 6 and comprises a cylindrical outer container 22 the lower end of which is closed by a bottom cap 24 and the upper end of which is attached and hermetically sealed to a disc-shaped head fitting 26 which includes a plurality of ports to receive the following connections:

- an inlet tube 28 to deliver refrigerant fluid from the evaporator;
- an outlet tube 30 through which refrigerant gas is passed from the accumulator to the compressor 12;
- an inlet connection 32 and an outlet connection 34 communicating with the heat exchange coil 20 for delivering therethrough the refrigerant fluid passing from the condenser 14 to the expander valve 16.

Figure 2:
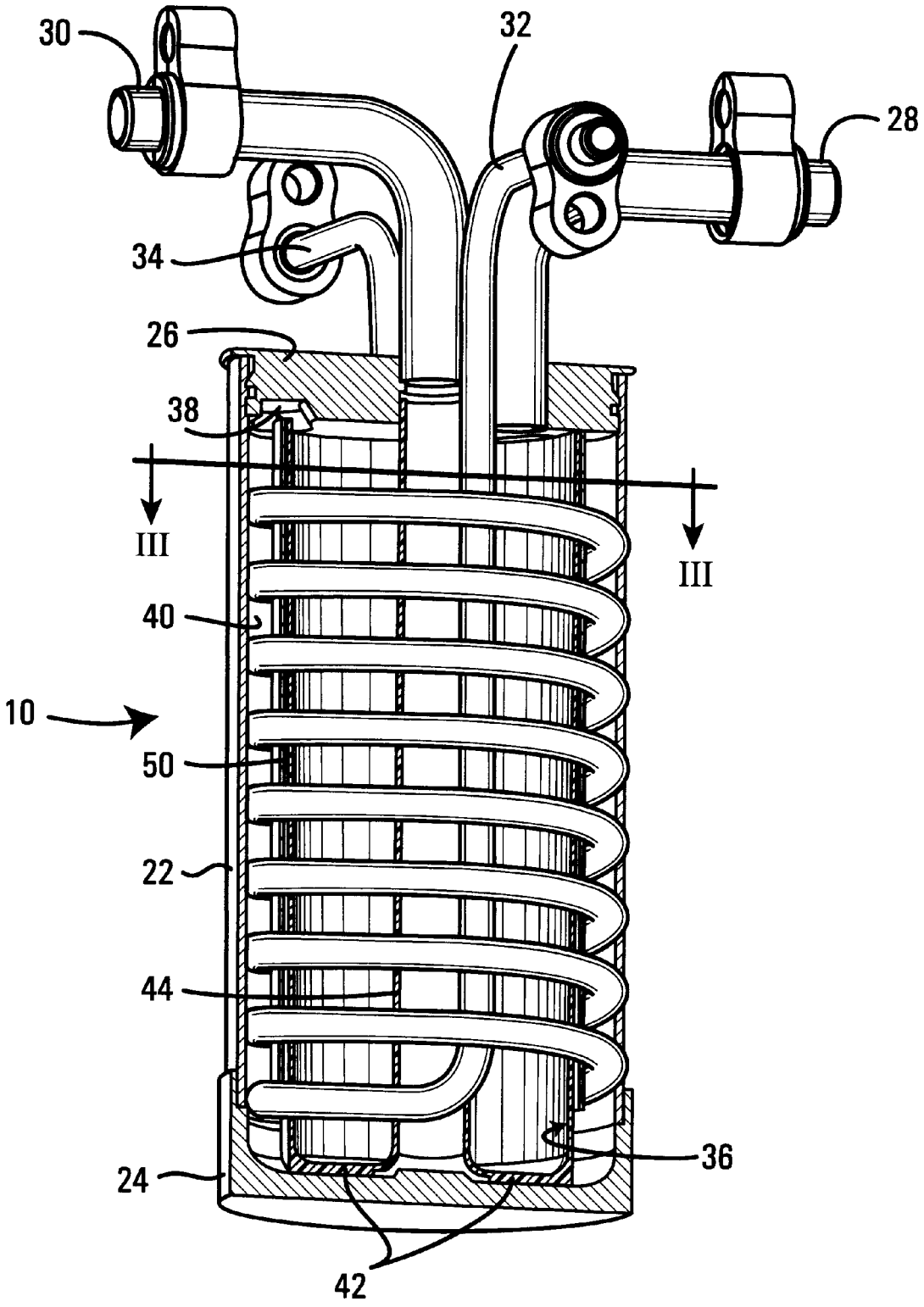
FIG. 2 is a somewhat schematic sectioned perspective view of the accumulator of the air-conditioning system shown in FIG. 1.
Figure 3:
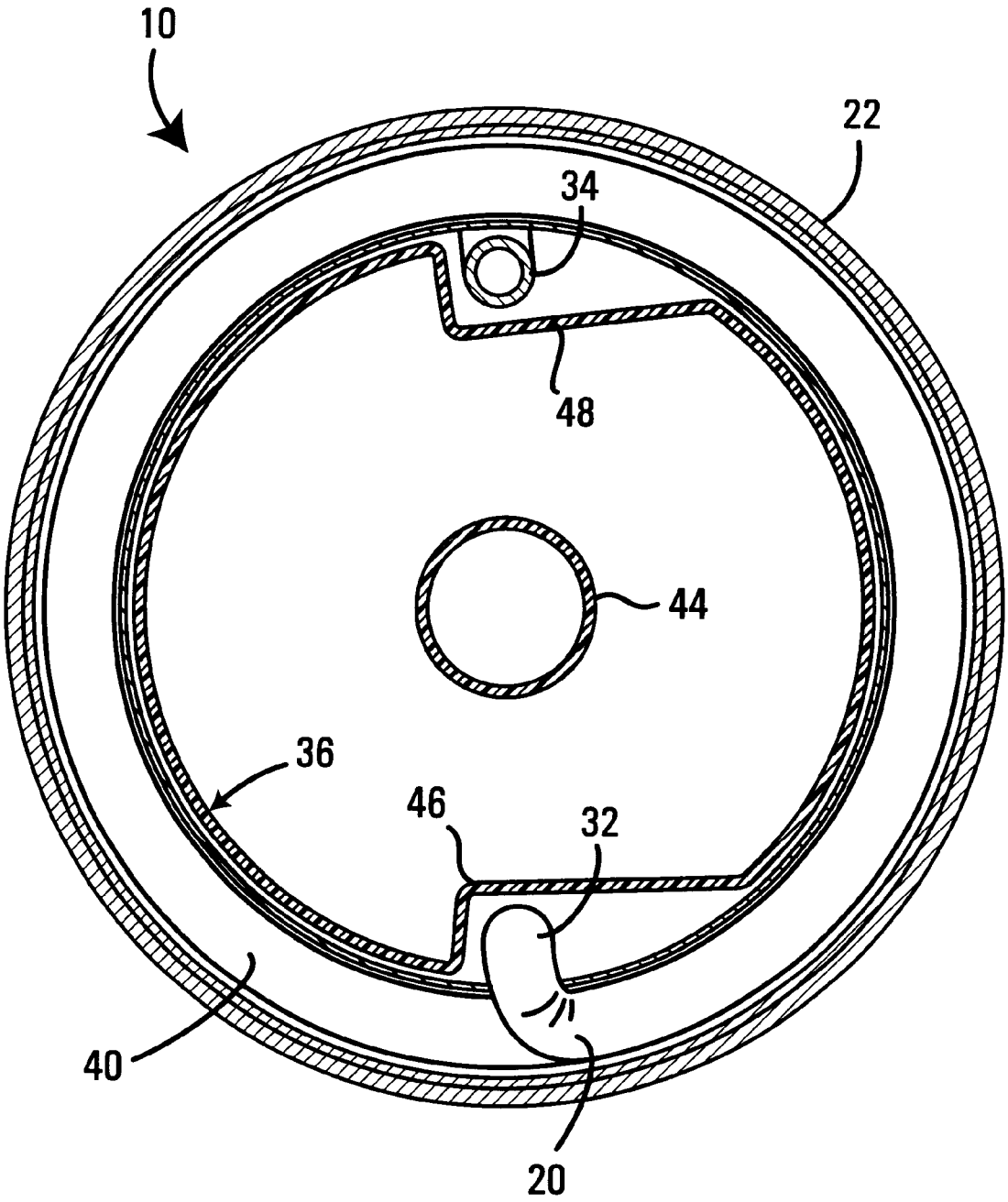
FIG. 3 is a sectional view to a larger scale taken approximately on the line III—III in FIG. 2.
Figure 4:
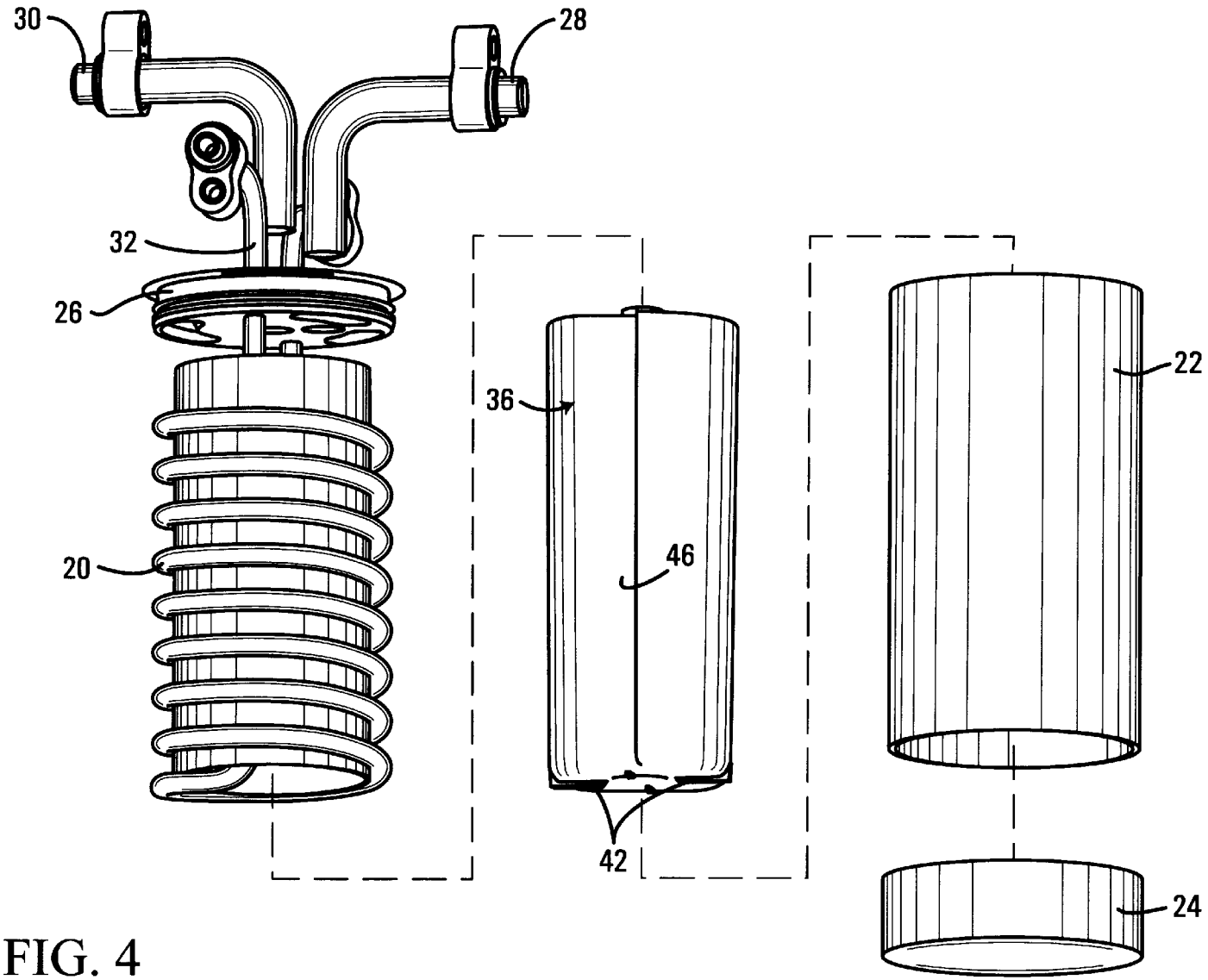
FIG. 4 is an exploded view corresponding to FIG. 2 showing the parts of the accumulator separated.
Figure 5:
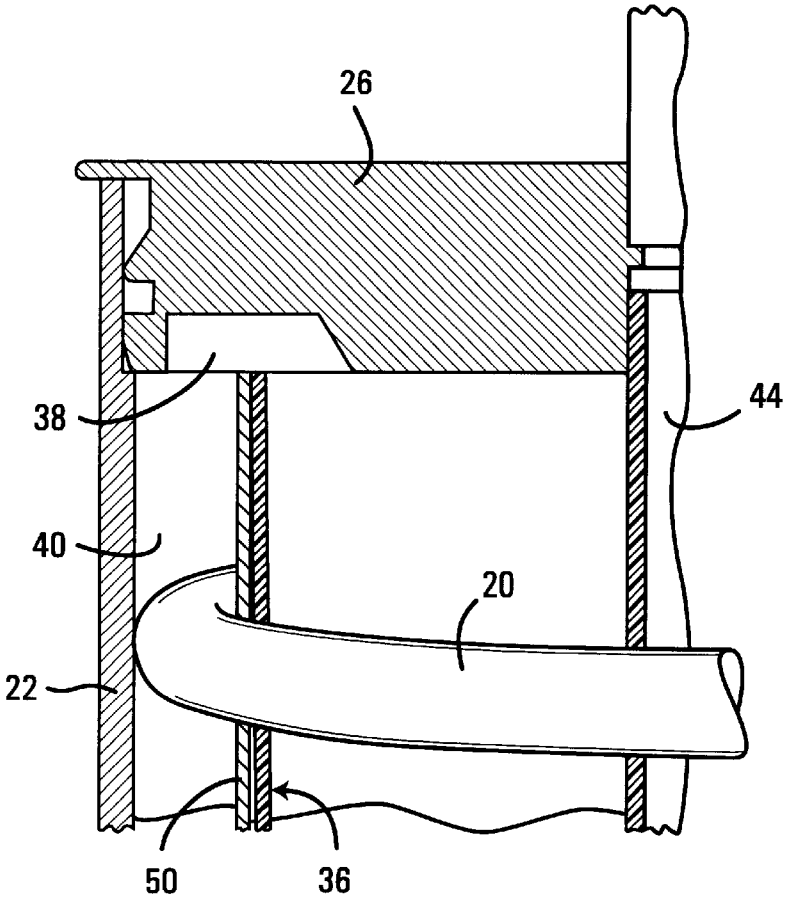
FIG. 5 and FIG. 6 show enlarged views of portions of FIG. 2 to illustrate the flow of refrigerant gas.
Figure 6:
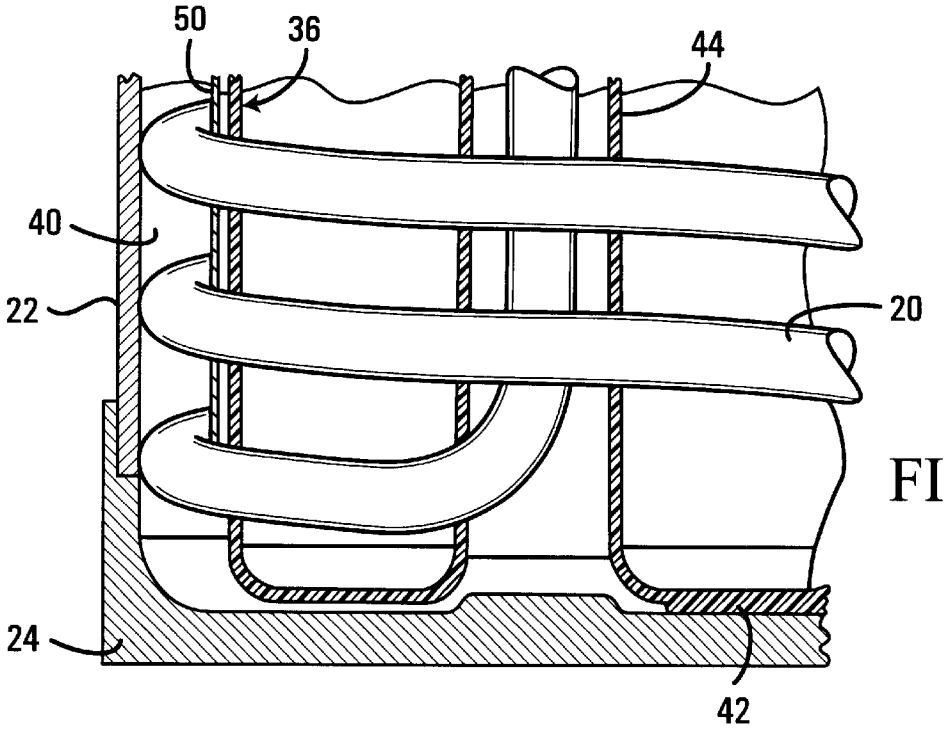

Within the outer container is a co-axially arranged cylindrical inner liner 36 the upper end of which is positioned closely against the underside of the head fitting 26 but which defines therewith transfer passages 38, one of which is seen in FIG. 2. A series of transfer passages 38 are arranged at spaced intervals around the periphery of the head fitting. Ribs between the passages 38 rest upon the upper end of the inner liner 36. As seen in FIG. 2, there is an annular passage 40 extending from top to bottom between the inner liner 36 and the outer container 22. A continuation of this passage 40 extends radially inwardly on the underside of the inner liner 36 which is spaced from the bottom cap 24 by projecting ribs 42. A central tube 44 which communicates with the annular passage 40 at the lower end of the accumulator extends centrally upwardly therein and is connected with the outlet tube 30, both being hermetically sealed to the head fitting 26.

The inlet connection 32 for the heat exchanger coil 20 extends vertically to near the bottom of the accumulator, as best seen in FIG. 2, the coil then extending helically upward in the annular space 40, the upper end of the coil turning vertically to merge with the outlet connection 34. To accommodate the vertical arrangement of the connections 32 and 34, the inner liner is formed with axially extending recesses 46, 48 (FIG. 3) in its outer surface. In these recesses, the connections 32, 34 are accommodated in such a way that they do not project beyond the cylindrical envelope defined by the outer surface of the inner container. The inner container 36 and the inlet and outlet connections 32, 34 are surrounded by a closely fitting outer liner 50 which defines the inner cylindrical surface of the annular passage 40. This annular passage is of constant radial width that corresponds closely to the outside diameter of the tubing forming the heat exchanger coil 20 so that the latter fits snugly between the outer liner 50 and the outer container 22. As will be evident from FIGS. 2, 5 and 6, the outer liner 50 extends from the upper edge of the inner liner 36 over the major portion of the length of the latter, terminating slightly above the location of the lower end of the coil 20.

IN OPERATION

Refrigerant fluid at low pressure is delivered from the evaporator through the inlet tube 28 into the inner liner 36 where it separates, the liquid fraction thereof gathering at the lower end of the inner liner together with a minor quantity of entrained oil that is typically included to provide lubrication for the compressor.

As determined by the demand of the heating or cooling load, the compressor 12 is driven to draw gaseous refrigerant from the accumulator.

Suction applied by the compressor communicates through the central tube 44, the annular space 40, and the transfer passages 38 with the interior of the inner liner 36. Thus refrigerant gas from this region is drawn through the transfer passages 38 into the annular passage 40. According to the suction demands of the compressor the low pressure created in the accumulator causes more or less of the liquid refrigerant to evaporate. However the refrigerant gas cannot pass directly to the lower end of the annular passage, but rather is channelled by the coil 20 to descend in a helical path between the turns of the coil and in heat exchange relation thereto until it reaches the lower end of the accumulator from whence it can pass radially inwardly between the projecting ribs 42. During this descent the refrigerant gas picks up heat from the coil 20 thus ensuring that the refrigerant delivered to the compressor is completely vaporized. This is achieved without excessively heating the liquid refrigerant within the lower end of the inner liner 36 by virtue of the fact that the latter is made of a poorly heat-conducting plastic, and further by the presence of the outer liner 50 which may also be of a heat insulating material. It will be noted that refrigerant gas in the passage 40 cannot move directly to the bottom of the passage through the recesses 46, 48 formed in the inner liner, since these are effectively blocked off by the outer liner 50.

As described in our above referenced International PCT application, the inner liner 36 will typically include a desiccant mass (not shown) to extract any moisture that may be present in the refrigerant fluid. Furthermore as also described in that application the lower ends of the inner container 36 may contain a filter and a bleed hole through which oil gathering there can be drawn into the refrigerant gas as it moves across the underside of the inner liner 36.

It will be observed that the refrigerant gas leaving the accumulator through the passage 40 flows in counter-current relationship to the warm refrigerant fluid moving through the coil 20 and thus the refrigerant gas passes the warmest region of the coil immediately before it flows beneath the lower end of the inner liner into the central tube 44. This arrangement enhances the effect of the heat transfer.

It is conventional in accumulators particularly accumulators for use in automotive air-conditioning systems, to provide for baffle means to prevent liquid refrigerant that enters the accumulator through the inlet pipe 20 from passing directly to the outlet passage, and any of the various means known in the prior art can be provided for this purpose. The design of the accumulator shown in FIGS. 2 to 6 provides a baffle effect by the configuration of the underside of the head fitting 26. The inner end of the inlet tube 28 on the underside of the head fitting 26 is surrounded by a recessed groove which prevents any tendency for liquid refrigerant clinging to the edge of the tube 28 from travelling across the under surface of the head fitting 26. Additionally, the transfer passages 38 spaced around the upper end of the inner liner 36 are in fact offset slightly above the level of the lower surface of the head fitting 26.

Figure 7A:
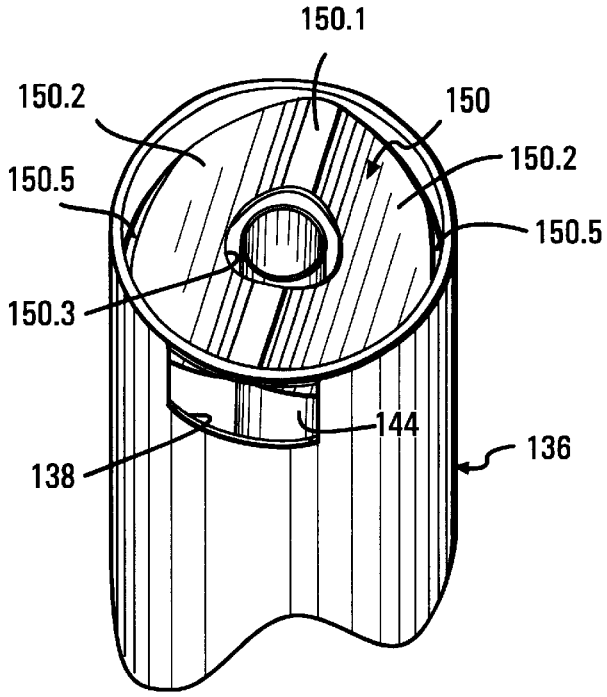
FIG. 7A is a fragmentary schematic perspective view of an upper portion of the accumulator shown in FIG. 7.
Figure 7:
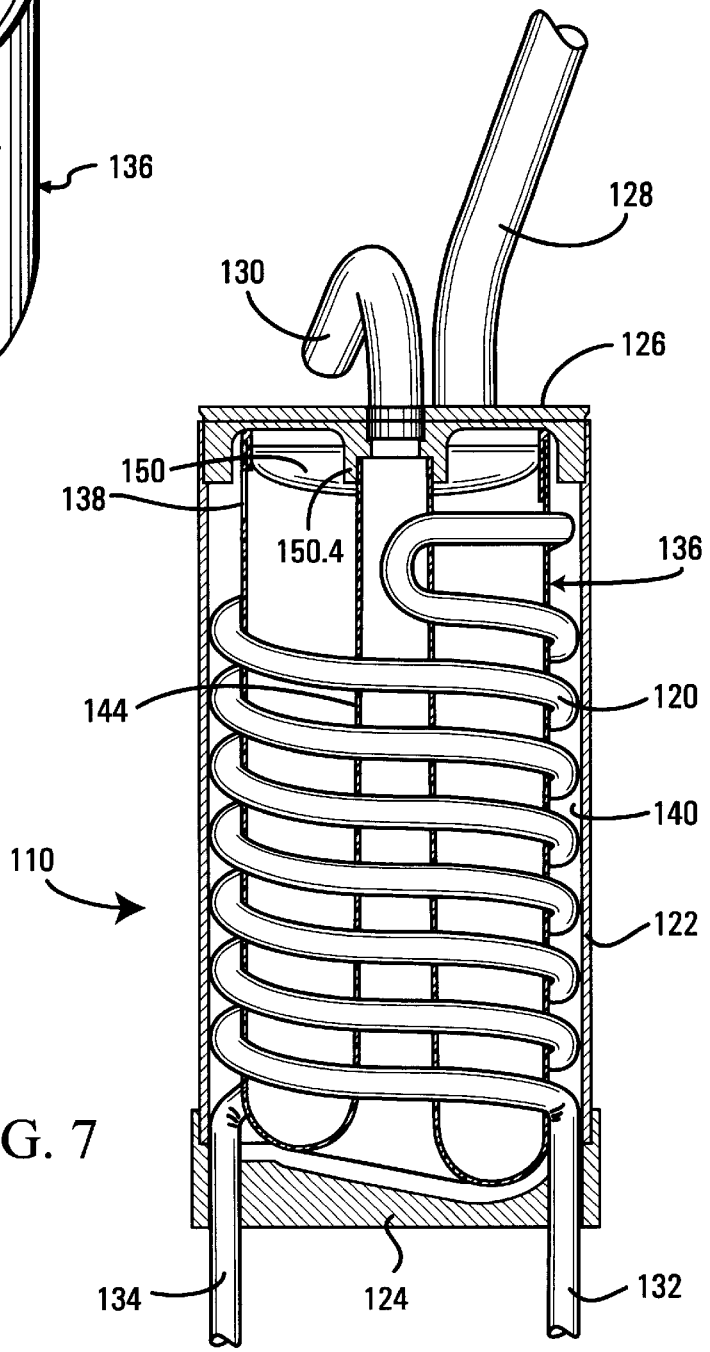
FIG. 7 is a somewhat schematic longitudinal sectional view showing an alternative embodiment of the accumulator of the present invention.

Although the accumulator of FIGS. 2 to 6 shows all of the fluid connections extending through the head fitting 26, other arrangements are possible, for example as shown in FIG. 7 where the accumulator 110 has only the inlet tube 128 delivering refrigerants from the evaporator and the outlet tube 130 delivering refrigerant gas from the accumulator to the compressor are arranged in the head fitting 126. In this embodiment the heat exchange coil 120 as before extends helically in closely fitting relationship in the passage 140 between the outer container 122 and the inner liner 136. However in this embodiment the coil 120 is a double helix so that both its inlet connection 132 and outlet connection 134 pass through the bottom cap 124 of the accumulator. Thus, in alternate turns of the coil 120 the refrigerant fluid flows in opposite directions. In this embodiment the outer surface of the inner liner 136 can be perfectly cylindrical and therefore there is no requirement for an outer liner such as that shown at 50 in FIGS. 2 to 6.

The embodiment of FIGS. 7 and 7A also demonstrates one method for incorporating a deflector 150 into the accumulator. As is more clearly shown in FIG. 7A, the deflector 150 is saddle-shaped, having a diametral crest 150.1 from which extend two downwardly sloping half circular flanks 150.2. A central circular hole 150.3 in the crest surrounds the upper end of the central tube 144 of the inner liner 136 and is sized to seal around a short tubular socket 150.4 on the underside of the head fitting 126. The deflector 150 can be made from a sheet metal disk having a diameter corresponding to the internal diameter of the inner liner 36, and thus abuts the inner liner at opposite ends of the crest 150.1 and in regions adjacent thereto, the lower sides of the flanks 150.2 being separated from the inner wall of the liner 136 by crescent shaped passages 150.5. On the underside of the deflector 150 spaced from the inlet tube 128 a transfer passage 138 communicates the interior of the inner liner 136 with the annular passage 140. The upper side of this passage 138 is of wide angled inverted V shape and is blocked by the peripheral edge of the deflector 150 so that there is no communication into the passage 138 from the upper side of the deflector. In operation, the refrigerant gas and liquid from the evaporator delivered into the accumulator through the inlet tube 128 will impinge upon the crest 150.1 to one side of the socket 150.4 and flow into the reservoir section through the openings 150.5. Refrigerant gas exiting the reservoir section of the accumulator will be drawn through the transfer opening 138 to enter the heat exchange section provided by the annular passage 140 and thereafter will exit the accumulator through the central tube 144 and the outlet tube 130.

Figure 8:
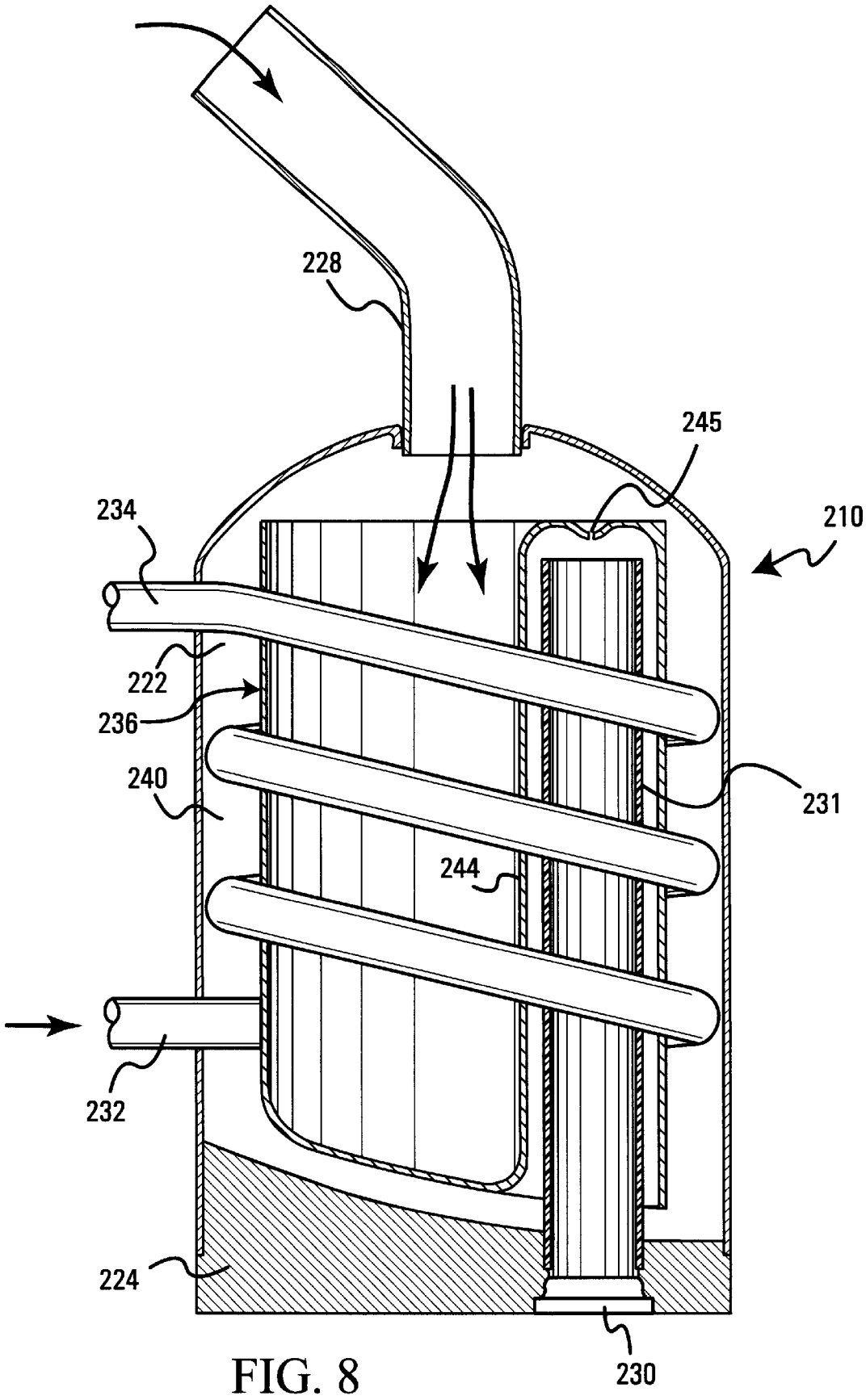
FIG. 8 is a longitudinal sectional view of a further possible accumulator configuration in accordance with the present invention and FIG. 9 is a longitudinal sectional view of another further possible accumulator configuration in accordance with the present invention.

A still further possible configuration is shown in FIG. 8. Here the inlet tube 228 opens centrally into the upper end of the outer container 222 which has an integral top surface. However in this embodiment the cylindrical inner liner 236 has an upwardly extending central tube 244 that is closed at its upper end, apart from a small anti-siphon hole 245. The outlet 230 for gas delivered from the accumulator to the compressor is formed in the bottom cap 224, this outlet 230 communicating with a vertically extending tube 231 that terminates near the closed upper end of the tube 244. In this embodiment the heat exchange coil 220 as before is arranged in any convenient manner in the annular passage 240 between the outer container 222 and the inner liner 236. As shown in FIG. 8 the inlet 232 and the outlet 234 of the heat exchange coil 220 pass through the side wall of the outer container 222, although other configurations are possible.

Figure 9:
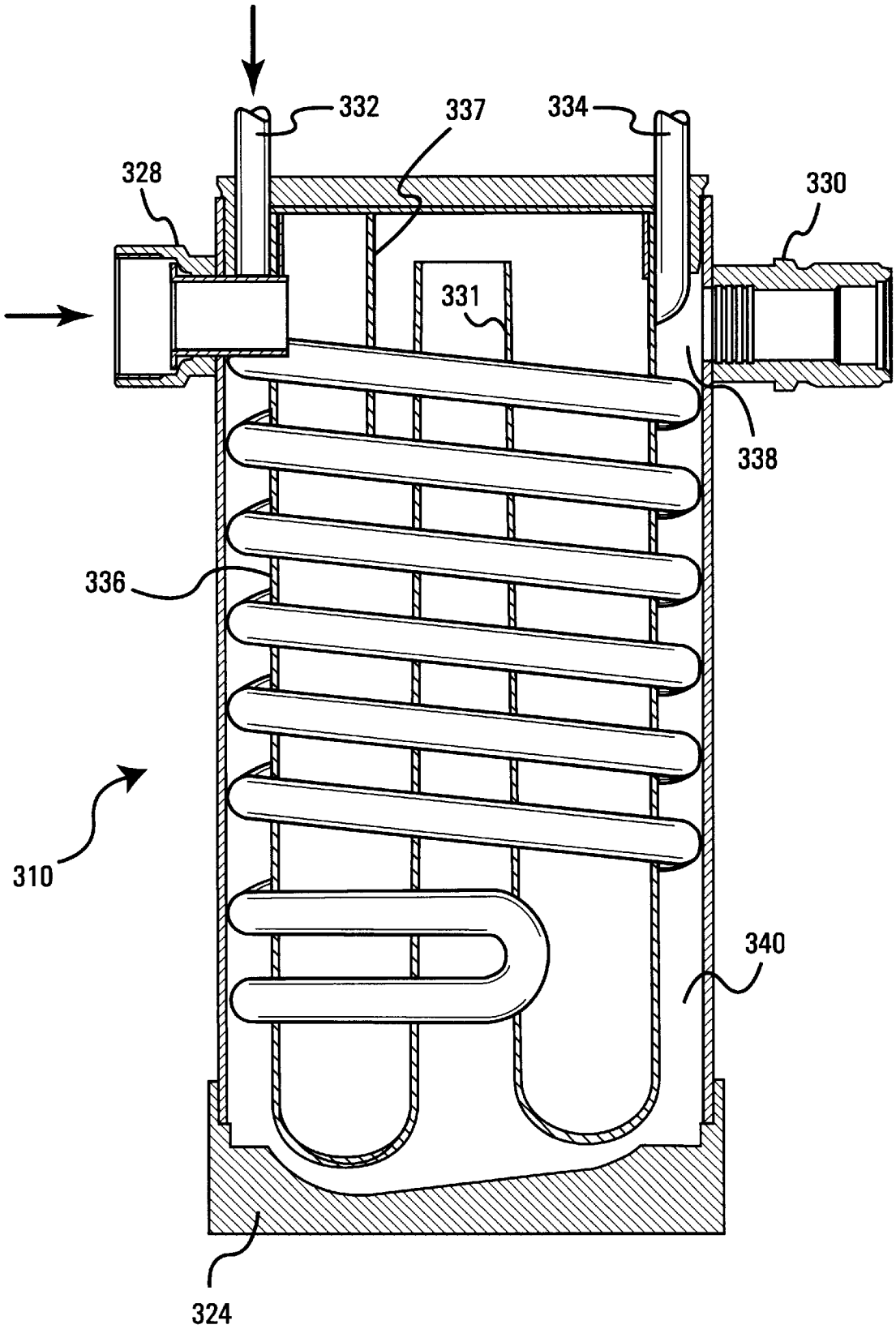

FIG. 9 shows still another possible embodiment. In this case the refrigerant gas and liquid from the evaporator enter through the inlet tube 328 in the side wall of the accumulator 310. The liquid impinges upon the (optional) deflector 337 and flows into the reservoir section. Under impetus from the compressor, the gas flows into the open upper end of the riser tube 331 of the liner 336. It then flows downward and through the space allowed between the liner and the bottom cap 324 and upwards through the heat exchanger passage 340. The gas collects in the cavity 338 at the top of the heat exchanger coil and exits the accumulator through the fitting 330 in the side wall.

Within the ambit of the invention significant changes can be made in the dimensions, shapes, sizes, orientations and materials to meet the specific requirements of the air-conditioning system that is being designed. Likewise the external structure such as the head fitting, the outer container, the position and arrangement of inlet and outlet ports can be modified as desired as can the type and arrangement of the desiccant container, oil bleed regulator and filter.

It should be understood that while for clarity certain features of the invention are described in the context of separate embodiments, these features may also be provided in combination in a single embodiment. Furthermore, various features of the invention which for brevity are described in the context of a single embodiment may also be provided separately or in any suitable sub-combination in other embodiments.

Moreover, although particular embodiments of the invention have been described and illustrated herein, it will be recognized that modifications and variations may readily occur to those skilled in the art, and consequently it is intended that the claims appended hereto be interpreted to cover all such modifications and equivalents.

What is claimed is:

1. An accumulator for use in an air-conditioning or heat pump system comprising:

a hermetically sealed outer housing comprising a top, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage, said inner liner including integral projections on the exterior thereof, said projections being positioned to engage interior surfaces of the base of the outer housing to maintain a predetermined spacing of the inner liner with respect to the outer housing a heat exchange tube positioned in said annular passage, said tube designed and configured to effect transfer of heat within said system from high pressure refrigerant to low pressure refrigerant, said tube having inlet and outlet ends that extend exteriorly of said outer housing;

transfer passages at respective upper and lower ends of said annular passage, one said transfer passage comprising an inlet communicating said annular passage to the interior of the inner liner and the other said transfer passage comprising an outlet communicating said annular passage to the exterior of said housing via said outlet opening;

the arrangement being such that vaporized refrigerant drawn from said inner liner enters said annular passage through said one transfer passage, flows through said annular passage and along said heat exchange tube to said other transfer passage from where it exits said accumulator via said outlet opening.

2. An accumulator as claimed in claim 1 wherein said heat exchange tube is arranged in the form of a coil of one or more pieces of tube, that extends helically in said annular passage between said outer housing and said inner liner.

3. An accumulator as claimed in claim 1 wherein said heat exchange tube defines within said annular passage an extended flow path for refrigerant gas leaving said inner container.

4. An accumulator as claimed in claim 2 wherein said helical coil defines a helical passage providing an extended flow path along which refrigerant gas leaving the inner liner must travel, said heat exchange tube having an outer diameter that is matched appropriately to the width of said annular passage.

5. An accumulator as claimed in claim 4 wherein said coil is arranged such that condensate delivered through said heat exchange pipe travels initially to a region near the lower end of said annular passage and travels upwardly in an annular flow through said coil.

6. An accumulator as claimed in claim 5 wherein said liner has an axially oriented recess formed on the outer surface thereof to accommodate a length of said heat exchanger tube leading from an inlet to the lower end of said coil.

7. An accumulator as claimed in claim 4 wherein said coil is arranged in a double helix.

8. An accumulator as claimed in claim 1 wherein the top of said outer housing comprises a cap constituting a separate component that is hermetically sealed to the top of the peripheral wall of the outer housing and which also defines therein said inlet opening, an outlet port for said outlet opening, and inlet and outlet passages for said heat exchange tube.

9. An accumulator as claimed in claim 1 wherein said one transfer passage is baffled to prevent entry thereto of liquid refrigerant delivered into said accumulator through said inlet opening.

10. An accumulator as claimed in claim 1 wherein the upper end of said inner liner is configured for engagement with said cap to provide proper alignment of said inner liner with respect to the outer housing.

11. An accumulator as claimed in claim 1 wherein said one transfer passage is configured to create turbulence in any flow of refrigerant gas passing therethrough.

12. An accumulator as claimed in claim 1 wherein said inner liner has baffles in the interior thereof to prevent excessive movement of refrigerant liquid contained therein.

13. An accumulator as claimed in claim 1 wherein said inner liner is of a material of low thermal conductivity to prevent excessive evaporation of refrigerant contained therein as a result of heat radiating from said heat exchange tube or from outer housing.

14. An accumulator as claimed in claim 1 wherein a deflector is incorporated for more effective separation of liquid and vapour.

15. An accumulator as claimed in claim 1 wherein the low-pressure refrigerant gas flows into the open upper end of a riser tube of the liner, through the gap between the liner and the bottom of the accumulator and flows upwardly over the heat exchanger in said annular passage, and out of the accumulator.

16. An accumulator for use in an air-conditioning system comprising:

a hermetically sealed outer housing comprising a cap, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular clearance, said inner liner having an upper end that lies in contact with or adjacent said cap;

a transfer passage for delivering refrigerant vapour from said container to said outlet opening;

an internal heat exchanger for the high-pressure refrigerant being positioned in said annular clearance, said heat exchanger having inlet and outlet ends that extend exteriorly of said outer housing;

wherein said inner liner is of low thermal conductivity to shield liquid refrigerant from excessive heat transfer from said outer container or from said coil.

17. An accumulator for use in an air-conditioning or heat pump system comprising:

a hermetically sealed outer housing comprising a top, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage;

a heat exchange tube positioned in said annular passage, said tube designed and configured to effect transfer of heat within said system from high pressure refrigerant to low pressure refrigerant, said tube having inlet and outlet ends that extend exteriorly of said outer housing;

first and second transfer passages at respective upper and lower ends of said annular passage, said first transfer passage comprising an inlet communicating said annular passage to the interior of the inner liner and said second transfer passage comprising an outlet communicating said annular passage to the exterior of said housing via said outlet opening;

a bleed orifice in the bottom of said inner liner to permit oil, which gathers at the bottom of said inner liner, to pass through and become entrained in refrigerant gas flowing to said outlet opening; guide ribs spanning between the bottom of said inner liner and said outer housing, said guide ribs being configured to direct flowing refrigerant gas to pass over said bleed orifice, wherein said first transfer passage is at an upper end of said annular passage, said second transfer passage being located between the bottom of said inner liner and the bottom of said outer housing;

the arrangement being such that vaporized refrigerant drawn from said inner liner enters said annular passage through said one transfer passage, flows through said annular passage and along said heat exchange tube to said other transfer passage from where it exits said accumulator via said outlet opening.

18. An accumulator as claimed in claim 17 wherein said guide ribs surround a major part of and define an entry port to provide a venturi throat in the region of said bleed orifice.

19. An accumulator for use in an air-conditioning or heat pump system comprising:

a heretically sealed outer housing comprising a top, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage;

a heat exchanger tube positioned in said annular passage, said tube designed and configured to effect transfer of heat within said system from high pressure refrigerant to low pressure refrigerant, said tube comprising a coil that extends peripherally and axially in said annular passage, said tube providing an inlet section and an outlet section of said coil, said tube being doubled back on itself in the coil so that said inlet and outlet sections are at one and the said end of the coil.

20. An accumulator as claimed in claim 19 wherein said coil has generally the form of a double helix.

21. An accumulator as claimed in claim 19 wherein said inlet section and said outlet section of the coil are connected to the exterior of the accumulator through a common end of the accumulator.

22. An accumulator for use in an air-conditioning or heat pump system comprising:

a hermetically sealed outer housing comprising a top, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage, said inner liner having an integral exit channel opening from the underside thereof and connected to said outlet opening;

a heat exchange tube positioned in said annular passage, said tube designed and configured to effect transfer of heat within said system from high pressure refrigerant to low pressure refrigerant, said tube having inlet and outlet ends that extend exteriorly of said outer housing;

first and second transfer passages at opposite ends of said annular passage, said first transfer passage comprising an inlet communicating said annular passage to the interior of the inner liner and said second transfer passage comprising an outlet communicating said annular passage to said exit channel;

the arrangement being such that vaporized refrigerant drawn from said inner liner enters said annular passage through said first transfer passage, flows through said annular passage and along said heat exchange tube to said second transfer passage from where it flows into said exit channel.

23. An accumulator as claimed in claim 22 wherein said heat exchange tube positioned in said annular passage has the form of a double helix coil.

24. An accumulator as claimed in claim 23 wherein in said coil said tube is doubled back on itself so that there is an inlet section and an outlet section at the same end of said coil.

25. An accumulator as claimed in claim 24 positioned in a generally upright orientation, said end of the coil being its uppermost end.

26. An accumulator as claimed in claim 24 wherein said accumulator is positioned in a generally upright orientation and said one end is the lowermost end.

27. An accumulator for use in an air-conditioning or heat pump system comprising:

a hermetically sealed outer housing comprising a top, an inlet opening, an outlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage;

said liner incorporating a deflector baffle positioned to be impinged by refrigerant delivered through said inlet opening;

a heat exchange tube positioned in said annular passage, said tube designed and configured to effect transfer of heat within said system from high pressure refrigerant to low pressure refrigerant, said tube having inlet and outlet ends that extend exteriorly of said outer housing;

a transfer passage at the upper end of said annular passage communicating said annular passage to the interior of the inner liner, said transfer passage being located in a position that is shielded with respect to refrigerant flowing from said inlet opening;

the arrangement being such that vaporized refrigerant drawn from said inner liner enters said annular passage through said transfer passage to flow through said annular passage and along said heat exchange tube.

28. An accumulator as claimed in claim 27 wherein said tube positioned in said annular passage is in the form of a double helix coil and is folded back on itself, said tube having an inlet section and an outlet section both located at the same end of said coil.

29. An accumulator as claimed in claim 28 where said inlet and outlet sections of said coil are both connected to the exterior through the upper end of said accumulator.

30. An accumulator as claimed in claim 27 wherein said inner liner incorporates an integral outlet tube extending upwardly therein and opening from the base thereof to the exterior of the accumulator.

31. An accumulator as claimed in claim 27 wherein said inner liner is of low thermal conductivity to shield liquid refrigerant contained by said inner liner from excessive heat transfer from the outer container or from said heat exchange tube.

32. An accumulator as claimed in claim 27 wherein said heat exchange tube is formed a helical coil within said annular space and is of a diameter to span said annular space to define therewith a helical flow channel between turns of said coil, one of said inlet end and said outlet end of said tube being in communication with a lower end of said coil through an axially extending tube section, said axially extending tube section being recessed within an axially extending recess in said inner liner and being enclosed within a cylindrical outer liner which forms an inner peripheral surface for said annular space.

* * * * *

UNITED STATES PATENT AND TRADEMARK OFFICE

CERTIFICATE OF CORRECTION

PATENT NO. : 6,463,757 B1
DATED : October 15, 2002
INVENTOR(S) : Dickson et al.

It is certified that error appears in the above-identified patent and that said Letters Patent is hereby corrected as shown below:

Column 10,
Line 46, delete "heretically" and substitute -- hermetically --

Signed and Sealed this

Fourth Day of March, 2003

JAMES E. ROGAN
*Director of the United States Patent and Trademark Office*